US007854485B2

(12) United States Patent
Berger

(10) Patent No.: US 7,854,485 B2
(45) Date of Patent: Dec. 21, 2010

(54) CLOSING AND OPENING DEVICE FOR DRAWERS

(75) Inventor: Horst Berger, Bielefeld (DE)

(73) Assignee: Alfil AG, Goetzis (AT)

( * ) Notice: Subject to any disclaimer, the term of this patent is extended or adjusted under 35 U.S.C. 154(b) by 741 days.

(21) Appl. No.: 11/721,889

(22) PCT Filed: Dec. 14, 2005

(86) PCT No.: PCT/EP2005/013455

§ 371 (c)(1),
(2), (4) Date: Jun. 15, 2007

(87) PCT Pub. No.: WO2006/066774

PCT Pub. Date: Jun. 29, 2006

(65) Prior Publication Data

US 2009/0273263 A1 Nov. 5, 2009

(30) Foreign Application Priority Data

| | | |
|---|---|---|
| Dec. 17, 2004 | (DE) | 20 2004 019 738 U |
| Feb. 19, 2005 | (DE) | 20 2005 002 699 U |
| Mar. 24, 2005 | (DE) | 20 2005 004 776 U |
| Jun. 21, 2005 | (DE) | 20 2005 009 860 U |

(51) Int. Cl.
*A47B 95/00* (2006.01)

(52) U.S. Cl. ..... 312/333

(58) Field of Classification Search ..... 312/333, 312/334.6, 319.1

See application file for complete search history.

(56) References Cited

U.S. PATENT DOCUMENTS 5,090,751 A * 2/1992 Kobayashi ..... 292/71
5,302,016 A 4/1994 Lautenschlaeger et al.
(Continued)

FOREIGN PATENT DOCUMENTS

| | | | |
|---|---|---|---|
| DE | 40 20 277 | A1 | 1/1992 |
| DE | 199 35 120 | A1 | 2/2001 |
| DE | 100 08 350 | A1 | 9/2001 |
| EP | 0 743 032 | A | 11/1996 |
| EP | 0 766 939 | A2 | 4/1997 |

*Primary Examiner*—Darnell M Jayne
*Assistant Examiner*—Dan Rohrhoff
(74) *Attorney, Agent, or Firm*—Norris McLaughlin & Marcus, P.A.

(57) ABSTRACT

Closing and opening device for drawer pull-out guides (10) with a guide rail (12) to be fixed on a carcass wall of a piece of furniture and a running rail (14) which is mounted so as to be displaceable relative to the guide rail—optionally with a central rail (11) interposed—and is to be fixed on the drawer. On a latch housing (22) disposed on one of the two aforementioned outer rails there is provided a movable catch component (24) which is pretensioned by a spring arrangement in a bistable manner into two end positions spaced from one another in the direction of movement of the drawer, and the catch component has a seat (36) for a dog (26) which is provided on the other rail and which moves into the seat during the relative displacement of the rails as the closed position is approached and pivots the pretensioned movable catch component (24) and thereby unlocks it from the associated end position. The catch component is moved under the action of the spring tension into the other end position and by way of the dog (26) held in the seat (36) it entrains the rail associated therewith in the direction of retraction of the drawer. An opening and closing device (20) which acts on the catch component (24) on the one hand and on or in the catch housing (22) on the other hand and which, when a pushing in movement in the direction of closing the drawer is exerted on the drawer which is retained in the closing position by the closing and opening device, displaces the catch component (24) and by way of the dog (26) engaging in the seat (36) of the catch component it displaces the running rail (14) and thus a drawer held on the running rail by a predetermined amount in the direction of opening the drawer.

27 Claims, 7 Drawing Sheets

U.S. PATENT DOCUMENTS 5,306,081 A * 4/1994 Fukumoto ..... 312/334.44
5,364,179 A * 11/1994 Brustle et al. ..... 312/333
5,474,375 A * 12/1995 Hollenstein et al. ..... 312/319.1
6,736,471 B2 * 5/2004 Lin ..... 312/333
6,953,233 B2 * 10/2005 Lam et al. ..... 312/333
7,028,370 B2 * 4/2006 Hoshide et al. ..... 16/96 R
7,097,220 B2 * 8/2006 Haba ..... 292/341
7,249,813 B2 * 7/2007 Gasser ..... 312/333
7,278,664 B2 * 10/2007 Su et al. ..... 292/304
7,399,041 B2 * 7/2008 Prentner et al. ..... 312/333
7,533,946 B2 * 5/2009 Hoffman ..... 312/333
7,654,626 B2 * 2/2010 Silverbrook et al. ..... 347/2
2003/0117048 A1 6/2003 Mueller
2003/0234604 A1 12/2003 Lin
2004/0107536 A1 * 6/2004 Hollenstein ..... 16/94 R
2008/0030111 A1 * 2/2008 Liu ..... 312/221

* cited by examiner

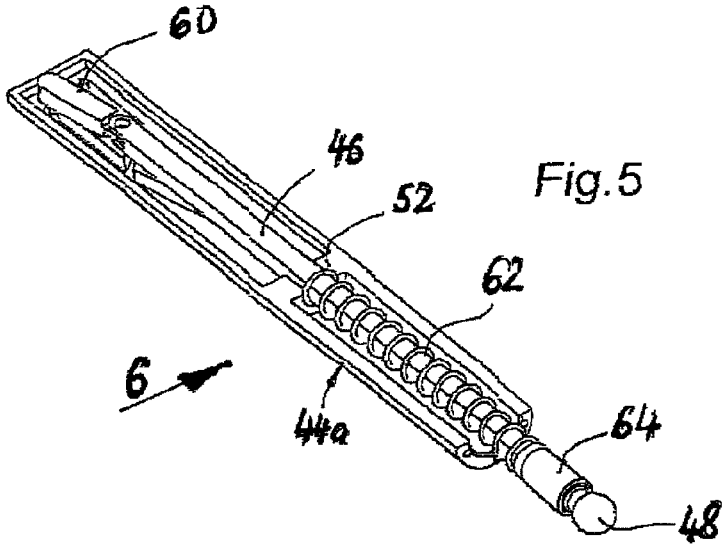
Fig.5
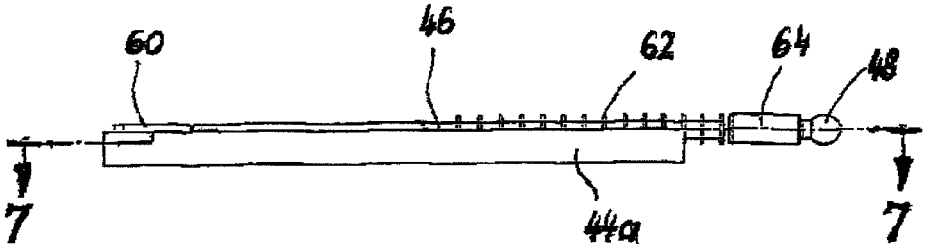
Fig.6
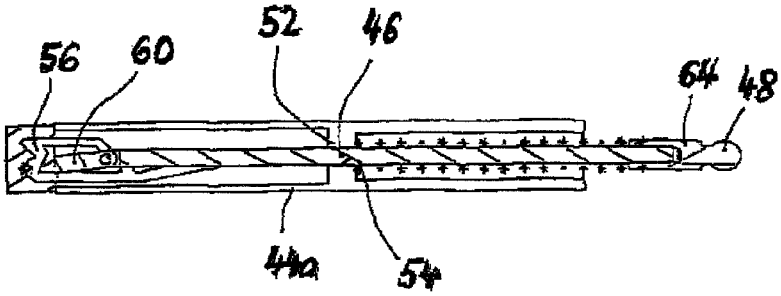
Fig.7
Fig.4
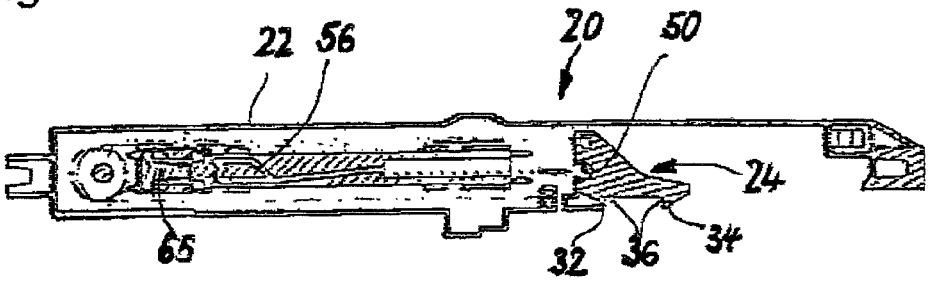

CLOSING AND OPENING DEVICE FOR DRAWERS

The invention relates to a closing and opening device for drawer pull-out guides with a guide rail to be fixed on a carcass wall of a piece of furniture and a running rail which is mounted so as to be displaceable relative to the guide rail—optionally with a central rail interposed—and is to be fixed on the drawer, wherein on a latch housing disposed on one of the two aforementioned outer rails there is provided a movable catch component which is pretensioned by a spring arrangement in a bistable manner into two end positions spaced from one another in the direction of movement of the drawer, and the catch component has a seat for a dog which moves into the seat during the relative displacement of the rails as the closed position is approached and pivots the pretensioned movable catch component and thereby unlocks it from the associated end position, as a result of which the catch component is moved under the action of the spring tension into the other end position and by way of the dog held in the seat it entrains the rail associated therewith in the direction of retraction of the drawer.

For guiding of drawers so that they can be pulled out in the carcass of drawer cabinets, use is made almost exclusively nowadays of pull-out guides with a guide rail fixed on the inner face of the cabinet side wall and a running rail which is to be fixed on the drawer and is longitudinally guided by rollers or antifriction bearings on guideways. Due to these pull-out guides mounted on rollers or antifriction bearings the drawers have a very easy action, they can be pulled out and pushed in without significant application of force. However, this easy action also has the disadvantage that drawers closed with momentum strike the cabinet carcass as they reach the closed position and due to the reaction force occurring thereby they are again—at least partially—guided back in the direction of opening, i.e. are opened. Therefore fittings for such pull-out guides have been developed which come into action as the closed position is approached and ensure that unwanted opening of the drawer from the closed position is not possible. Apart from the mechanical or magnetic latches previously provided for this purpose, in recent times fittings have been developed which are to be attached to the pull-out guides themselves and act between the guide rail and the running rail, these fittings taking the form of the automatic retraction devices referred to in the introduction in which the retraction and retaining function in the closed position has also to some extent been supplemented by a damping device which slows down the momentum of the drawer before it reaches the closed position. (DE 40 20 277 C2).

In an effort for visual/aesthetic reasons to avoid handle fittings provided on the outside of the front panel of the drawer for opening and closing the drawer, so-called touch-latch fittings have already been developed (EP 0 766 939 B1), which make it possible for a drawer located in the closed position to be made to move in the direction of opening by a pressure additionally exerted on the front panel towards the interior of the carcass, so that the rear face of the front panel can then be engaged behind in the edge region and the drawer can be opened—even without the present of a handle fitting. Such touch-latch fittings were hitherto constructed as fittings to be mounted separately on the drawer and/or the cabinet carcass, in which a spring-loaded pressure piece can be put successively into two displacement positions offset with respect to one another in the longitudinal direction. The attachment of these touch-latch fittings takes place in such a way that the pressure piece in the outer advanced displacement position projects so far in the direction of the drawer that as the drawer closes before it reaches the closed position it encounters the end of the pressure piece. For complete closing pressure must then be exerted on the front panel of the drawer in the direction of closing. Then as soon as the closed position is reached, the pressure piece is locked in the retracted position of the drawer and then does not exert any opening force on the front panel of the drawer. Thus the separate attachment of these fittings requires a considerable expenditure on fitting.

By contrast, the object of the invention is to create a closing and opening device with the functional principle of the touch-latch fittings which can be pre-fitted on the drawer pull-out guides.

This object is achieved according to the invention by an arrangement of the opening and closing device on a drawer pull-out guide of the type referred to in the introduction, having a touch-latch mechanism which acts on the catch component on the one hand and on or in the catch housing on the other hand and which, when a pushing in movement in the direction of closing the drawer is exerted on the drawer which is retained in the closing position, displaces the catch component and by way of the dog engaging in the seat of the catch component it displaces the running rail and thus a drawer held on the running rail by a predetermined amount in the direction of opening the drawer.

In a preferred alternative embodiment of the invention the design can be such that the opening and closing device has an elongate hollow housing, one end of which is retained on or in the catch housing, wherein a coupling rod disposed so as to be longitudinally displaceable in the hollow housing is guided out of the other end of the housing and the end of the coupling rod projecting out of the hollow housing is coupled to the catch component, and that the co-operating functional elements of the touch-latch mechanism are provided on the opposing end of the coupling rod received in the hollow housing on the one hand and in the housing facing away from the catch component on the other hand and the coupling rod is pretensioned by a pretensioned spring in the direction of a longitudinal displacement towards the catch component.

In this case the touch-latch mechanism preferably has a cam of cardioid shape which is provided in the interior of the elongate hollow housing and in which a control projection provided on the end of the coupling rod within the housing engages in a manner which is known per se.

Since during the locking or unlocking operation the control projection guided in the cam must also carry out a transverse movement in addition to the longitudinal displacement predetermined by the design, in an advantageous alternative embodiment of the invention it is provided that the control projection projects from the free end of a lever which is mounted on the end of the coupling rod within the housing so as to be pivotable about a control projection which engages in the cam parallel to the longitudinal central axis. This avoids a distortion of the coupling rod which would hinder the longitudinal displacement of the coupling rod in the elongate hollow housing.

Moreover, in a central portion of the inner elongate hollow housing the coupling rod is advantageously guided so that it is displaceable in the longitudinal direction of the housing but is not rotatable relative to the housing in order to ensure that the control projection cannot come out of the cam unintentionally due to turning of the coupling rod in the housing.

The elongate hollow housing advantageously has at least two housing halves put together along a plane extending approximately centrally through the housing in the longitudinal direction, of which one is provided with the cam in the interior of its end region remote from the catch component, whilst the interior of the other housing half lying opposite the housing half provided with the cam is of hollow construction in such a way that the control projection provided on the end of the coupling rod within the housing can follow the transverse movements transmitted to it during a longitudinal displacement of the coupling rod by the cam, wherein the spring under compression pretension is supported on or in the end region of the hollow housing nearest the catch component on the one hand and in the region of the coupling of the coupling rod on the catch component on the other hand.

The longitudinal division of the elongate housing into two housing halves enables a simple production of the housing halves and the correct installation of the coupling rod in the necessary engaged position of the control projection in the cam.

In this case the elongate hollow housing advantageously has the external shape of an elongate cylinder. The open and closed position then corresponds in its external design and appearance to the damping devices advantageously used in the known automatic retraction devices. Then with appropriate adaptation of the dimensions it is even possible as required to provide a closing and opening device of the type under discussion here with a damping device or a touch-latch mechanism or to re-equip the automatic retraction device appropriately.

In an advantageous alternative embodiment of the invention the elongate hollow housing can be supported at its end remote from the catch component on a stop which is adjustable in the longitudinal direction of the catch housing, for example an end surface of a setscrew screwed into a threaded bore in the catch housing. By changing the depth to which the setscrew is screwed into the threaded bore the position of the elongate hollow housing in the catch housing can be changed, as a result of which an adjustment of the joint spacing of the front panel in the closed position is possible.

Alternatively the design can also be such that the stop is formed by a set wheel which projects on an end face of the housing remote from the catch component, is screwed on with a threaded lug and provided with a complementary threaded hole.

In an advantageous alternative embodiment an overload safety device which prevents premature failure of the closing/opening function of the device can be provided in that between the adjustable stop and the catch housing a spring is provided which cushions jerky stresses transmitted to the components of the touch-latch mechanism via the catch component as a drawer is closed.

In this case the spring is preferably formed by at least one helical spring fitted under compression pretension.

The elongate hollow housing is advantageously guided so as to be longitudinally displaceable in the catch housing and its end remote from the catch component is supported in the catch housing by way of an interposed pretensioned spring, wherein a stop which advantageously delimits the displacement path of the elongate hollow housing in the direction toward the catch component due to the pretension of the interposed spring is provided in the catch component.

In this case the design is then preferably such that the stop surface of the stop which supports the housing is constructed so as to be adjustable in the direction of displacement of the elongate housing.

The stop surface is then preferably formed by the free end of the shank of an adjusting screw which is screwed into a threaded bore in the catch housing and engages on a matching surface of the elongate housing, wherein the end of the adjusting screw lying opposite the matching surface is guided out of the catch housing and is provided with means for turning the shank, e.g. a head or a recess for the application of a turning tool.

The adjusting screw can then be provided in the catch housing so that it is oriented obliquely with respect to the direction of displacement of the elongate housing in such a way that when the shank of the adjusting screw is turned in the direction of screwing into the threaded bore the elongate housing is advanced against the direction of action of the pretension of the spring and when the shank is turned in the opposing direction the housing is advanced in the direction of action of the pretension of the spring. In this way it is then possible for the front panel of a drawer in the closed position to be aligned exactly with the front panels of adjoining closed drawers of a drawer cabinet.

The catch housing can advantageously be provided with means for fixing on the underside of the guide rail of an associated pull-out guide in such a way that the catch component with the seat projects laterally adjacent to the guide rail in the direction towards the running rail, and the dog provided on the running rail protrudes into the displacement path of the seat in the catch component.

In this case the design is advantageously such that in the prescribed fixing position of the catch housing the catch component and the dog are provided on an associated guide rail laterally adjacent to the side thereof which faces the carcass.

As an alternative to the arrangement of the control projection described above the touch-latch mechanism can also be constructed on a lever mounted pivotably on the end of the coupling rod within the housing so that the control projection is disposed so as to be displaceable transversely with respect to the longitudinal direction of the coupling rod but in the longitudinal direction of the coupling rod is not displaceable on the end of the coupling rod within the housing.

In this case the design can then be such that the end of the coupling rod within the housing has a guide head which is widened transversely with respect to the longitudinal direction of the coupling rod, wherein in the side of the guide head directed towards the cardioid-shaped cam a transversely extending guide groove is provided in which a support element is displaceably mounted, wherein the control projection projects from the underside of the support element facing the cam and engages in the cam.

In this case the support element can advantageously have the shape of a cylindrical body of which the height is substantially equal to the depth of the guide groove and the diameter is equal to the width of the guide groove, wherein the control projection which engages in the cardioid-shaped control groove projects centrally from the end face of the body facing the cam and for its part then advantageously has the shape of a pin with a circular cross-section in which the diameter is equal to the width of the cardioid-shaped control groove. By comparison with the design of the support element which is likewise possible per se as a slide block inserted exclusively displaceably in the groove, the design as a cylindrical body has the advantage that the support element can additionally turn in the guide groove.

In order to improve the guiding of the support element in the guide groove it is then advantageous if there is provided centrally in the base of the guide groove of the guide head an elongate hole in which a guide pin with a circular cross-section engages which projects centrally from the end face of the cylindrical body remote from the cam, the diameter of the guide pin being substantially equal to the width of the elongate hole.

The free end of the piston rod projecting out of the elongate hollow housing is advantageously coupled in an articulated manner on the catch component—in order to avoid bending stresses of the coupling rod—in such a way that the catch component is pivotable relative to the end of the coupling rod.

In an advantageous alternative embodiment of the invention the pivotable coupling of the coupling rod on the catch component is achieved in that on the end of the coupling rod there is provided a joint head of substantially circular cross-section which for pivotable coupling on the catch component engages in a joint head seat in the catch component delimited in the shape of a circular arc over more than 180°, and that in the region which is open towards the coupling rod the joint head seat is constructed so that it is resiliently expandable in such a way that when a predetermined tensile force is exerted on the coupling rod or on the catch component the joint head disengages from the joint head seat in the sense of separating these parts from one another as the open mouth region expands resiliently.

In this case the joint head advantageously has the shape of a ball head which is connected to the end of the coupling rod by way of a connecting shank with a cross-sectional diameter which is reduced by comparison with the diameter of the ball head.

The invention is explained in greater detail in the following description of four embodiments in connection with the drawings, in which:

FIG. 4 shows a schematic sectional representation of the closing and opening device viewed in the direction of the arrows 4-4 in FIG. 2;

FIG. 5 shows a perspective view of the lower half of the touch-latch mechanism of the closing and opening device according to FIGS. 2 and 3;

FIG. 6 shows a side view in the direction of the arrow 6 in FIG. 5;

FIG. 7 shows a sectional view in the direction of the arrows 7-7 in FIG. 6;

Figure 11:
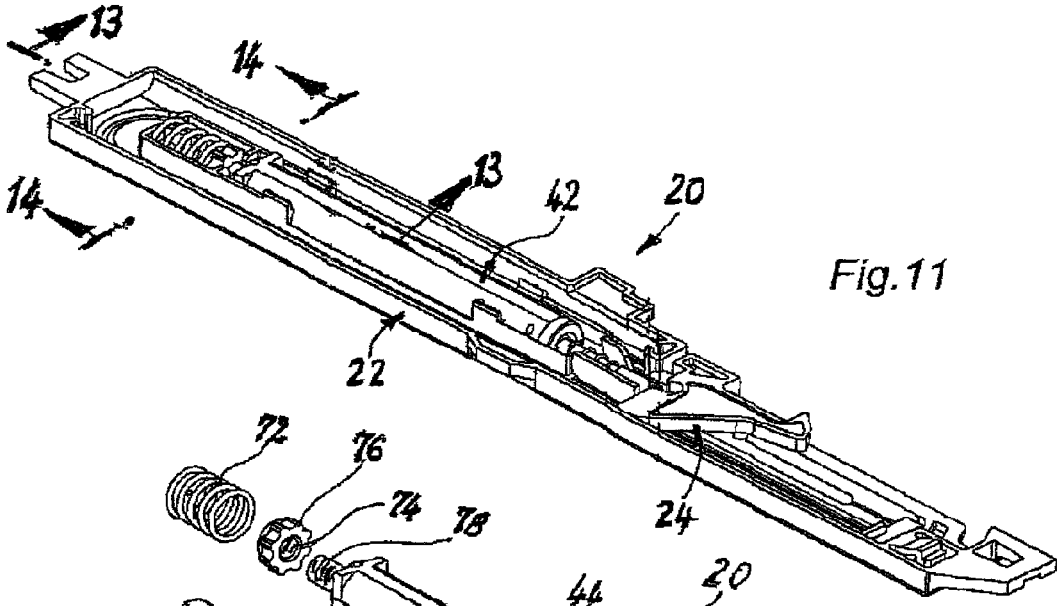
Figure 12:
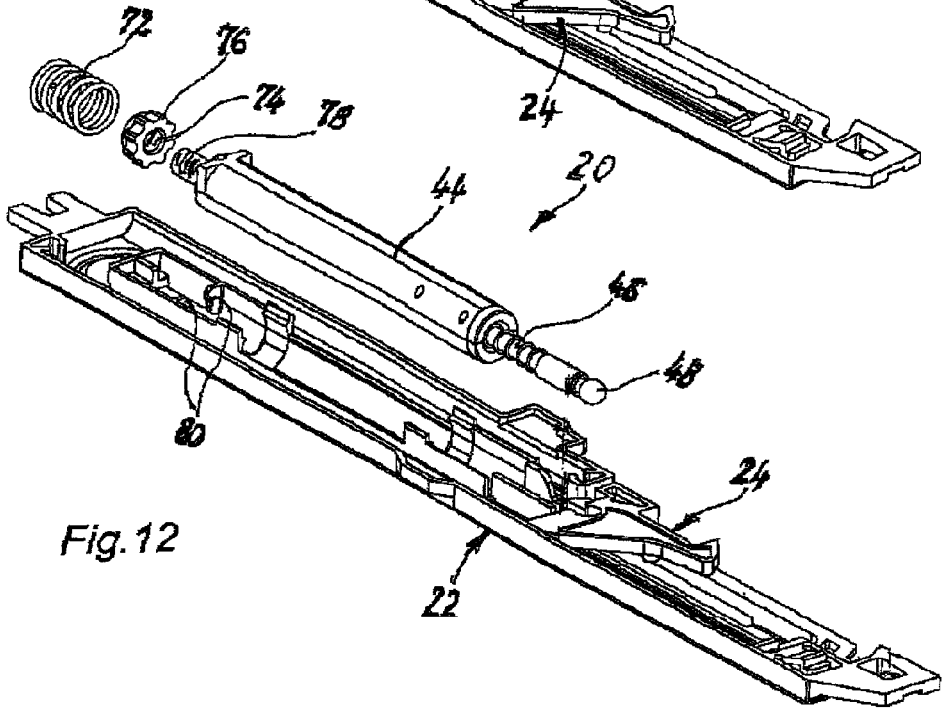
Figure 13:
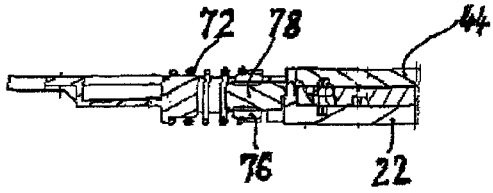
Figure 14:
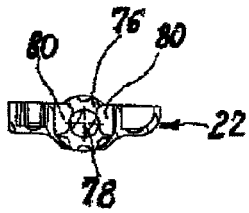
Figure 15:
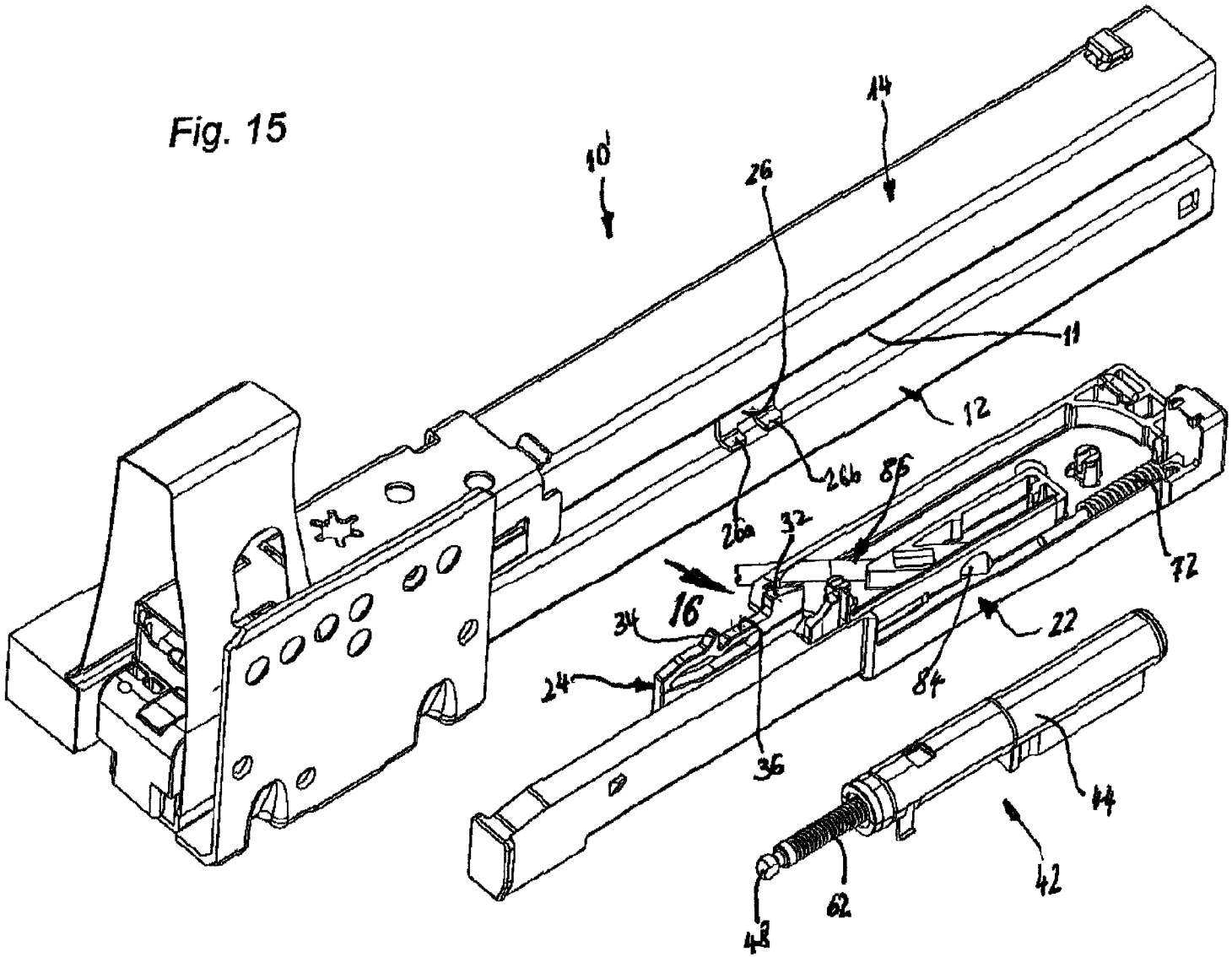
Figure 16:
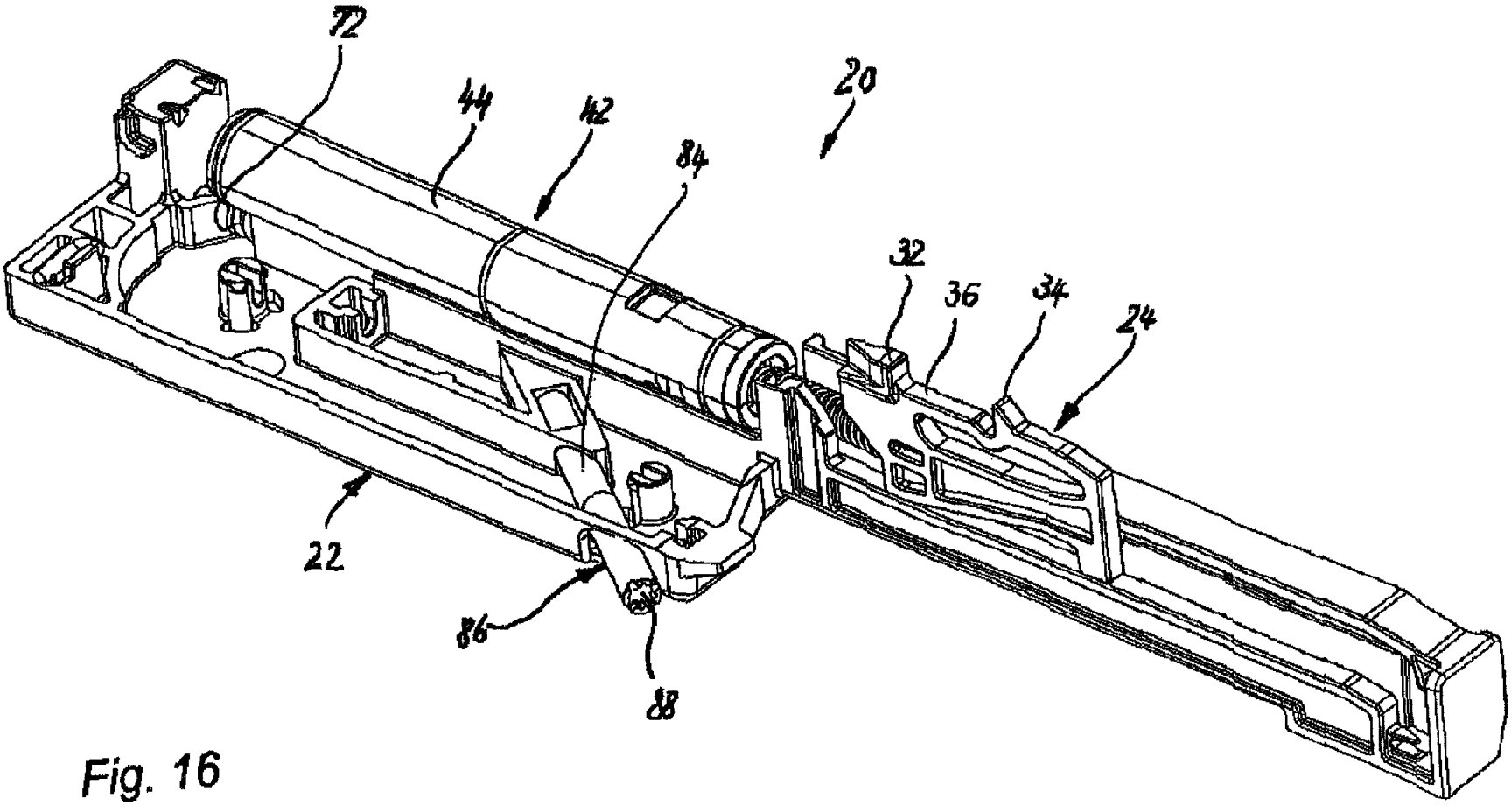

FIG. 11 shows a perspective view of a third embodiment of a closing and opening device according to the invention in which, apart from the spring provided as an overload safety device which is described in the second embodiment shown in FIG. 8, the longitudinal adjustability of the housing of the touch-latch mechanism which is also described in connection with the first embodiment is provided in the catch housing—in modified form;

FIG. 12 shows the embodiment illustrated in FIG. 11 in which the actual closing and opening device is shown in a position above the catch housing in which it is released from its seat in the catch housing;

FIG. 13 shows a partial section through the third embodiment viewed in the direction of the arrows 13-13 in FIG. 11;

FIG. 14 shows a section viewed in the direction of the arrows 14-14;

FIG. 15 shows a perspective view of a portion of a drawer pull-out guide constructed as a full pull-out means and also of a fourth embodiment of an associated closing and opening device which is shown separately and partially in an exploded state; and FIG. 16 shows a view of the closing and opening device in the direction of the arrow 16 in FIG. 15.

Figure 1:
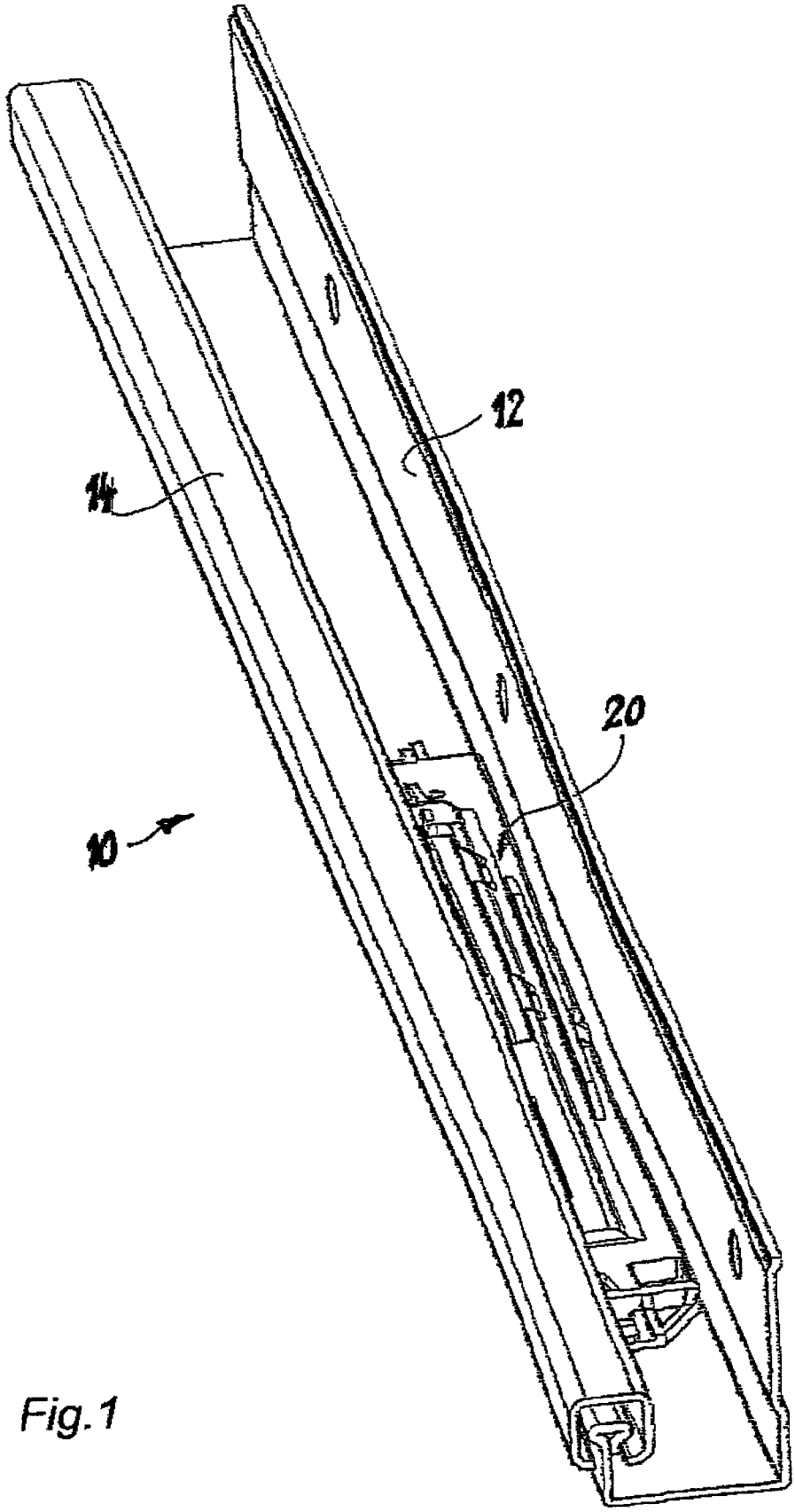
FIG. 1 shows a perspective view of a first embodiment of a drawer pull-out guide in which is integrated a closing and opening device which is provided in the manner according to the invention with a touch-latch function.
Figure 2:
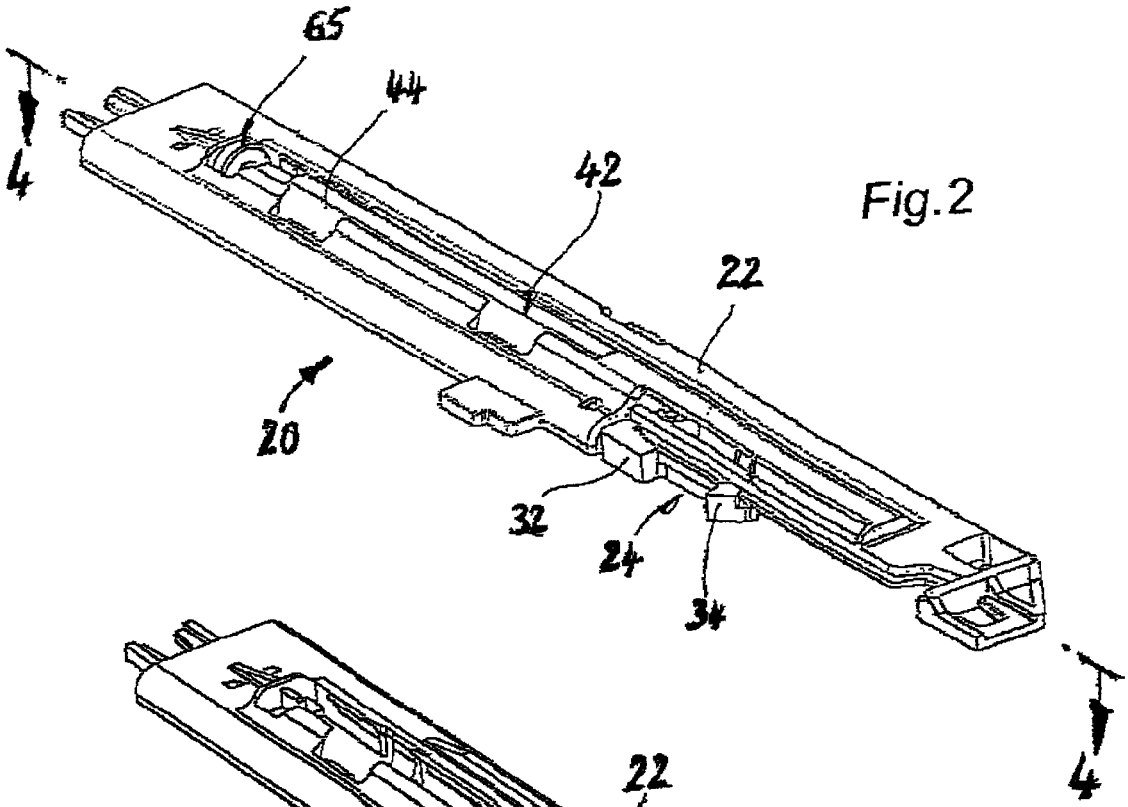
FIG. 2 shows a perspective view of the closing and opening device according to FIG. 1.

FIG. 1 shows a drawer pull-out guide which is denoted in its entirety by 10 and in the special case is constructed as a simple pull-out means with a profiled guide rail 12 to be fixed on the side wall of a cabinet carcass and with a profiled running rail 13 associated with the drawer and guided by antifriction bearings so as to be longitudinally displaceable on guideways constructed on the guide rail. Since such pull-out guides—whether in the form of the illustrated simple pull-out means 10 or also in the form of a full pull-out means additionally provided with an interposed central rail—are known per se a detailed description of such pull-out guides is omitted here.

The basic design of the automatic retraction device which is provided in the illustrated pull-out guide 10 and is further developed for the closing and opening device 20 according to the invention is also known, wherein a drawer mounted in a cabinet carcass by means of such a pull-out guide is forcibly retracted into the carcass this automatic retraction device as the drawer approaches the closed position.

The further development according to the invention of such automatic retraction devices—which are known per se—is described below in connection with FIGS. 2 to 7 for a closing and opening device 20 with touch-latch function.

The closing and opening device 20 has an elongate flat catch housing 22 in which a flat-disc-like catch component 24 is guided so as to be displaceable between two end positions. This guiding takes place by the engagement of two guide lugs which project from the flat part of the catch component 24 and are spaced from one another in the direction of displacement and which engage in the manner of a slide block in a guide groove which is provided in the associated wall of the catch housing 22 and extends in a straight line over the greater part of its longitudinal extent. This guide groove is bent in a curved shape at the end which is shown on the right in FIGS. 2, 3 and 4 and at the bottom in FIG. 1, so that as this end region is reached the front guide lug engaging in the guide groove is guided out of the straight path of movement so that the catch component 24 carries out a tipping movement.

Figure 3:
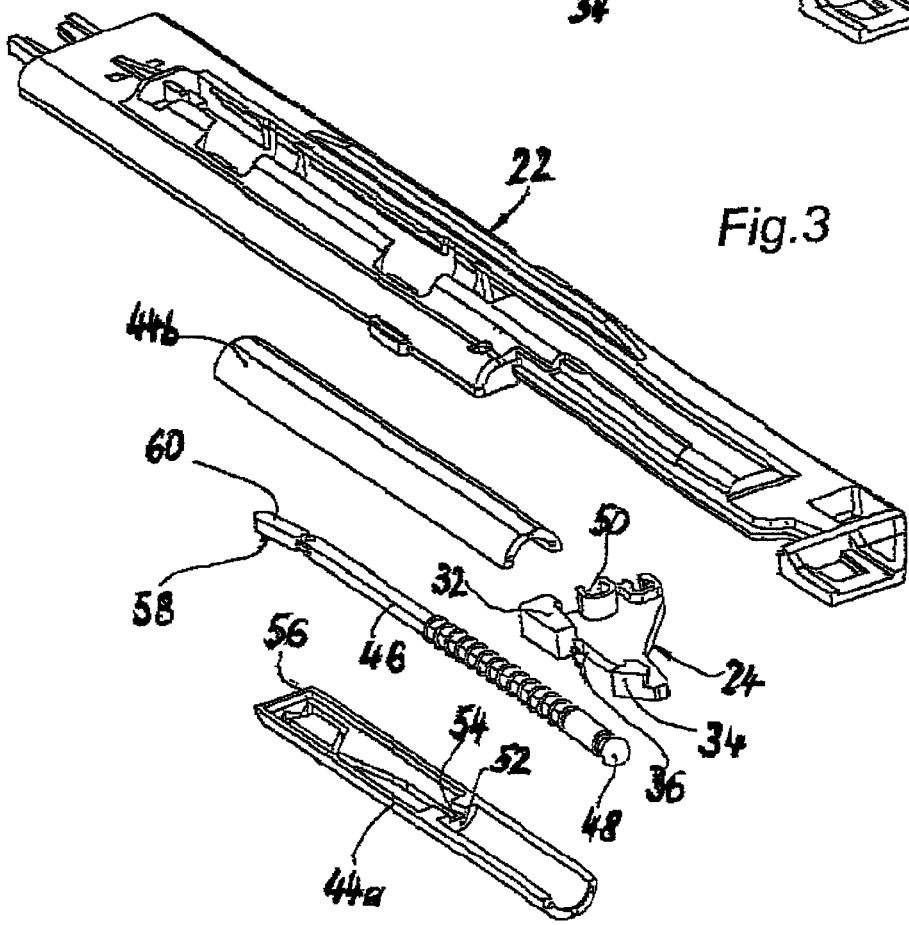
FIG. 3 shows a perspective view of the closing and opening device corresponding to FIG. 2 in an exploded representation of its co-operating functional elements.

On the upper edge the catch component 24 has two projections 32 and 34 which project over the edge of the catch housing 22 and are spaced from one another and between which is constructed a seat 36 for a dog—not shown in the drawings—which is formed by two pins projecting downwards from the running rail 14 and which displaces the catch component forcibly in the catch housing 22 as the drawer is pulled out relative to the catch housing in the pull-out direction. Thus during the pull-out operation the catch component 24 is entrained by the dog out of the end position illustrated in FIGS. 2 and 4 and associated with the closed position and into the aforementioned tipped end position. When this end position is reached the catch component is then tipped—as mentioned—and as a result the projection 34 which is at the front in the pull-out direction is guided in the downward direction into the interior of the catch housing 22 and is locked in this tipped position by the tensional force of a spring. This spring is denoted by 62 in FIGS. 5 and 6. The dog associated with the running rail can then come out of the seat 36 and thus the running rail 14 which retains the drawer can be displaced without force in the guide rail 12 in the drawer pull-out direction. A closing and opening device 42 having an elongate hollow housing 44 which in the assembled state has the external shape of an elongate cylinder is provided in an elongate recess in the catch housing 22. This cylindrical housing 44 is composed of two housing halves 44*a* and 44*b* which are parted along a longitudinal central plane (FIG. 3). A coupling rod 46 which in the illustrated case has a square cross-section is guided so as to be longitudinally displaceable in this elongate cylindrical housing, wherein the end region of the coupling rod 46 shown on the left in each case in FIGS. 3 to 7 projects out of the cylindrical housing 44 and is provided at its end with a ball head 48 which is accommodated in an articulated manner in an associated seat 50 (FIGS. 3 and 4) of the catch component 24. When the catch component 24 is produced from a rigidly resilient plastics material the region of the catch component provided with the seat 50 can be constructed by corresponding shaping so that the seat expands resiliently when a tensile force directed in the longitudinal direction of the firmly retained coupling rod acts on the catch component and the ball head 48 then comes out of the seat. Thus in this way the articulated connection of ball head and catch component then simultaneously has the function of an overload coupling.

In the interior of the elongate housing 44 there is provided a radially inwardly directed wall portion 52 in which an opening 54 is provided which is shaped to correspond to the square cross-section of the coupling rod 46. Thus the coupling rod 46 passes through this opening 54 so as to be longitudinally displaceable, but in this case it is secured against twisting by the complementary square cross-sections of the opening and of the coupling rod.

In the region of the lower housing half 44*a* of the housing 44 which in FIGS. 3 to 7 is shown on the left of the radially inwardly directed wall portion 52 a cardioid-shaped cam 56 is formed in a planar wall portion in which a lug-like control projection 58 engages so as to fit and there can be displaced in the closed cardioid curve. The control projection 58 projects from the lower side of a short lever 60 closest to the cam, the lever 60 being articulated on the free end of the coupling rod 46 so as to be pivotable about a pivot axis extending parallel to the control lug. The lever 60 articulated pivotably on the end of the coupling rod 46 with the control projection engaging in the cam 56 form the functional components of a so-called touch-latch mechanism, i.e. the coupling rod 46 can be locked in two positions offset from one another in the longitudinal direction thereof against being pulled out of the housing 44. In the first retracted latched position the control projection 58 is located in the recessed region between the two laterally adjoining wings of the cardioid shape of the cam, whilst the second locked position is formed by the tip of the cardioid-shaped cam.

The locking in these two end positions takes place by a spring 62 which is constructed as a helical spring under compression pretension and surrounds the portion of the coupling rod 46 led out of the elongate cylindrical housing 44, the end of the spring within the housing being supported on the facing end face of the radial wall portion 52, whilst the opposing end is supported on the sleeve portion 64 of enlarged diameter which connects the ball head 48 to the free end of the coupling rod 46. Thus the spring 62 under compression pretension attempts to draw the coupling rod 46 out of the interior of the housing in the direction towards the catch component 24. In the two aforementioned locking end positions the pretension of the spring 32 ensures the respective locking engagement of the control projection 58 in the locked position of the cam. By pushing in of the coupling rod 46 the control projection is pushed out of the respective latched position of the cam and then due to the shape of the cam is displaced laterally from the latched position, so that during a subsequent opposing pull-out movement of the coupling rod the latching projection can move over into a laterally adjoining elongate portion of the cam extending substantially in the longitudinal direction and from there can move over into the region of the latched position in the cam associated with the respective other locking position. The functioning principle of this touch-latch mechanism operating with cardioid-shaped cam is known per se, so that it does not need to be explained in greater detail.

From the preceding explanations it can also be seen that due to the coupling already described between the closing and opening device 42 and the catch component 24 of the closing and opening device 20 a coupling to an associated drawer is provided. Therefore it is possible for a drawer which is located in the closed position, and retained in this closed position by the catch component 24, wherein the coupling rod 46 retains the control projection 58 disposed on the lever 60 in the locking position shown on the left in the drawings, to be brought out of locking engagement by a slight additional displacement of the drawer in the direction of pushing in, whereupon the control projection is displaced towards the right by the spring 62 into the second locked position and thereby pushes the catch component 24 and thus, by way of the dog on the running rail, the running rail and the drawer out of the interior of the carcass by an amount corresponding to the spacing between the locked positions of the control projection in the cam. In this case the front panel of the drawer then lifts off by a corresponding amount from the front face of the carcass and the drawer can be pulled out of the interior of the carcass by engagement behind the front panel.

In order in the closed position of a drawer to be able to adjust the joint spacing existing between the inner face of the front panel of the drawer and the front end faces of the carcass walls of a cabinet which accommodates the drawer—e.g. for adaptation to the corresponding joint spacing of adjacent drawers—it is advantageous to construct the housing 44 of the closing and opening device 42 so that it is adjustable in the longitudinal direction in the catch housing of the closing and opening device 20 and can be fixed in selectable longitudinal positions. This purpose can be served for example by a setscrew 65 which rests with the free end of its threaded shank on the end of the housing 44 remote from the catch component and is screwed into a threaded bore in the catch housing, the schematic position of the setscrew being indicated in FIG. 4 and the upper part of the screw head which can be manually actuated for adjustment being discernible in FIG. 2.

Figure 8:
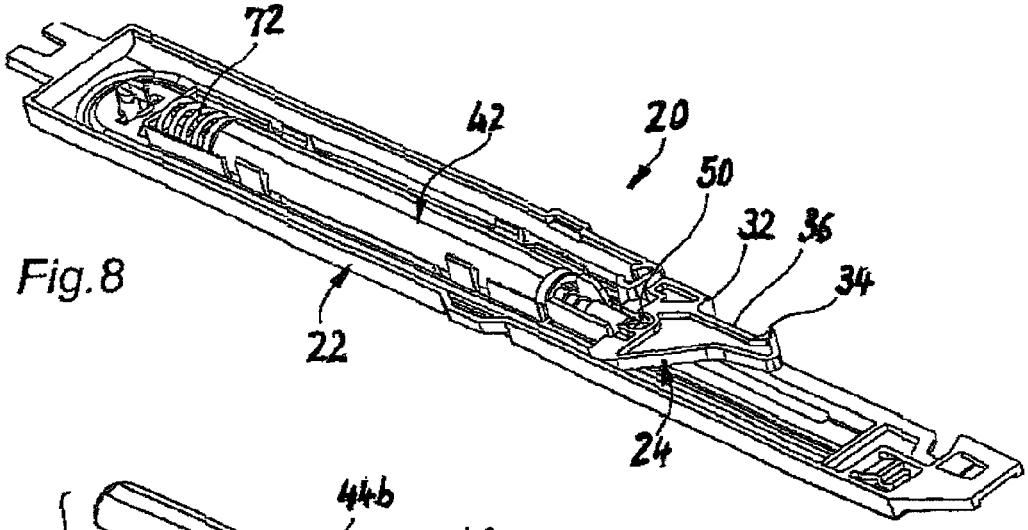
FIG. 8 shows a perspective view of a second embodiment of the closing and opening device similar to FIG. 2, but viewed from the opposite side.
Figure 9:
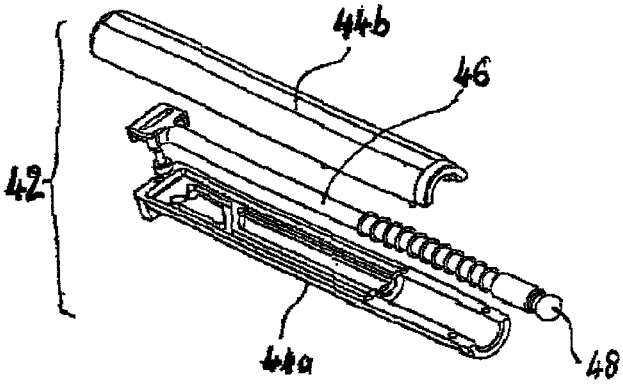
FIG. 9 shows an exploded representation of the closing and opening device provided in the embodiment according to FIG. 8.
Figure 10:
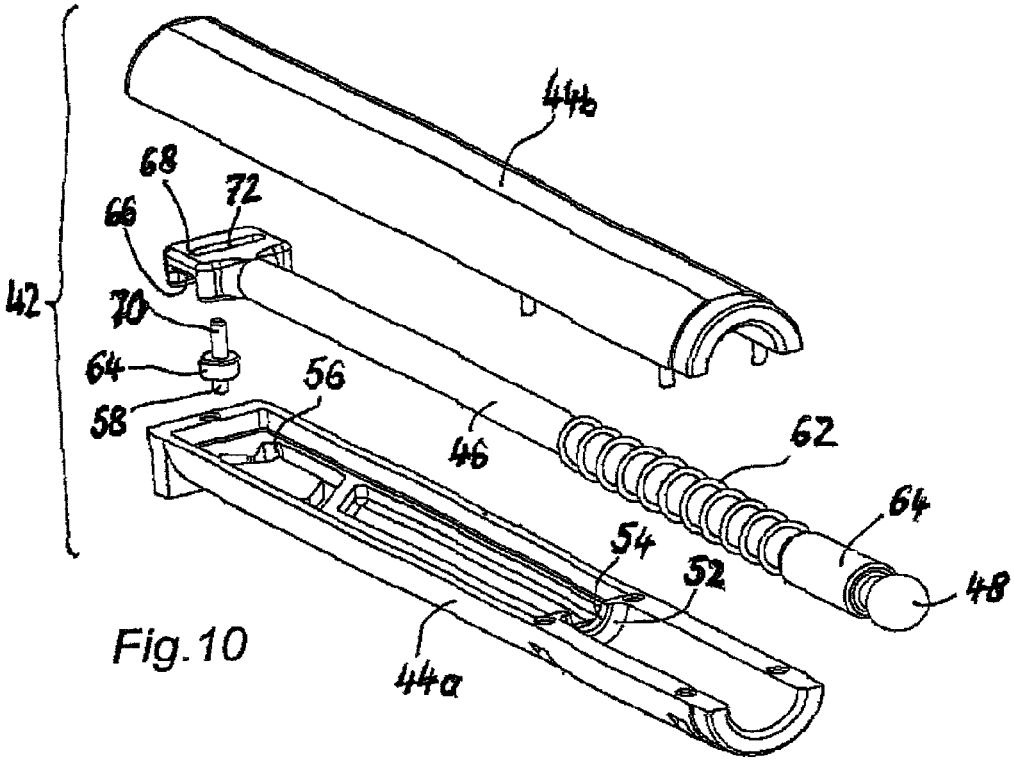
FIG. 10 shows the closing and opening device according to FIG. 9 on an enlarged scale.

FIGS. 8 to 10 show a further embodiment of a closing and opening device 20 which differs from the embodiment of the closing and opening device 20 according to the invention described above in connection with FIGS. 2 to 7 only in the nature of the transversely displaceable mounting of the control projection 58 on the end of the coupling rod 46, which in this embodiment has a circular cross-section, which is located within the housing and engages in the cardioid-shaped cam 56. Therefore in order to describe this embodiment it is sufficient next to describe only the differences which exist, whilst for the rest reference can be made to the preceding description of the first embodiment, since functionally corresponding components of both embodiments are assigned the same reference numerals in the drawings.

Instead of the arrangement of the control projection 58 on a lever arm, the control projection 58 constructed as a pin of circular cross-section now projects centrally from the lower end face of a support element constructed as a low cylindrical body 64 facing the cam 56 in the lower housing half 44*a*. The cylindrical body 64 is disposed so as to be transversely displaceable in a guide groove 66 extending transversely with respect to the longitudinal direction of the coupling rod in a widened guide head 68 integrally attached on the end of thee coupling rod 46 within the housing. The diameter of the cylindrical body 64 is substantially equal to the width of the guide groove 66 so that it can be displaced in the transverse direction in the guide groove. An additional guiding of the cylindrical body is also achieved in that a further guide pin 70 of circular cross-section engages centrally in an elongate hole 72 provided in the base of the guide groove 66. Thus the cylindrical body 64 can carry out the necessary transverse movement in the guide groove 66 of the guide head 68 during the following process of the control projection 58 engaging in the cam 56, wherein the body 64 can turn in the guide groove due to its cylindrical peripheral surface. Therefore jams cannot occur.

Moreover, FIG. 8 shows a spring 72 provided between the end face, remote from the catch component, of the housing 44 of the touch-latch mechanism disposed so as to be longitudinally displaceable in the catch housing 22 and an opposing end wall of the seat of the housing 44, wherein the spring acts as an overload safety device against damage to the functional element of the touch-latch mechanism by buffering the impact produced during the vigorous closing of a drawer as it reaches the end position.

A third embodiment of a closing and opening device according to the invention is shown in FIGS. 11 to 14, in which the aforementioned functions of adjustability of the joint spacing of the front panel of a drawer from the confronting end face of a cabinet carcass and overload safety against impacts is combined in one assembly. In this embodiment the spring 72 is not supported directly on the end face of the housing 44 but on the end face, remote from the housing, of a set wheel 76 provided with a central threaded bore 74. The set wheel 76 is screwed on a threaded lug 78 projecting integrally from the end face of the housing 44, so that the spacing between the end face of the housing and the confronting front face of the set wheel is infinitely variable by turning of the set wheel 76. The set wheel 76 is pushed by the spring 72 which is installed under compression pretension and in the illustrated case is constructed as a helical spring in abutment on two projections 80 which serve as stops projecting from opposing sides into the seat for the housing 44 and between which the threaded lug 78 of the housing 44 passes. As the set wheel 76 turns, its distance from the housing end face changes and the housing is displaced—as a function of the direction of turning—in the direction of opening or closing the drawer. Thus by way of the coupling rod 46 the catch component 24 also and a dog—which may if appropriate engage between the projections 32, 34 thereof—of the running rail 14 of a pull-out guide and a drawer mounted on the running rail, as a result of which the joint spacing between the rear face of the front panel of the drawer and the front end faces of the carcass walls of a cabinet accommodating the drawer changes correspondingly.

FIGS. 15 and 16 show a further embodiment of an opening and closing device 20 according to the invention which is intended for use on a pull-out guide 10 which is constructed in this case as a full pull-out means, in which the running rail 14 is not mounted directly on the guide rail 12 but by way of an interposed central rail 11. In this case the arrangement of the catch housing 22 takes place on the lower horizontal face onto the profiled face of the guide rail 12, wherein the region of the catch housing 22 which guides the catch component 24 displaceably in the catch housing projects into the space existing between the guide rail 12 and the inner face of the adjacent carcass wall in the prescribed installed position of the pull-out guide 10' in a cabinet carcass. In this space the catch component 34 is disposed displaceably in the catch housing 22 with the projections 32 and 34 which delimit the seat 36 pointing upwards in the direction towards the running rail 14. Accordingly the dog 26 which co-operates with the catch component 26 and is provided on the running rail 14 is placed on the vertical flank of the profile of the profiled rail forming the running rail closest to the carcass wall and point in the downward direction so that the horizontally projecting projections 26*a*, 26*b* which are spaced from the downwardly directed free edge of the dog project into the displacement path of the seat 36 of the catch component 24.

The elongate housing 44 of the actual closing and opening device 42 is disposed in the extension of the catch component 24 so as to be longitudinally displaceable by a predetermined displacement path in the catch housing 22 and—as also in the embodiments described above—is pushed by a spring 72 under compression pretension in the direction of the catch component 24 in abutment on a stop projecting into the displacement path of the housing 44 in the catch housing 22. In this case the stop is formed by the free end of the shank 84 of an adjusting screw 86 which is screwed into a threaded bore in the catch housing 22 and of which the opposing other end projects out of the catch housing 22 on the side remote from the carcass and in this end region is provided with means for turning the shank 84, for example the cross-slot 88 shown in FIG. 16 for application of the free end of the blade of a Phillips screwdriver.

In this case in the manner which can be seen in the drawings the shank 84 is oriented obliquely with respect to the direction of displacement of the elongate housing 44 and is disposed in the catch housing 22 so that in the event of turning the free end of the shank 84 forming the stop for the housing 44 changes its position in such a way that—depending upon the direction of turning—the elongate housing 44 is displaced in the catch housing 22 either against the direction of action of the helical spring 72 and with additional compression thereof or in the opposite direction with relaxation of the helical spring. As a result the position of the elongate housing 44 in the catch housing 22 is infinitely adjustable by a predetermined about in the pull-out direction of the drawers, so that the activation function of the touch-latch mechanism can be changed within the scope of the predetermined adjustment path in the horizontal direction. Thus as a result the clear gap dimension between the rear face of the front panel of a drawer and the front end wall of the appertaining cabinet carcass which is necessary for activation of the touch-latch function can be adjusted precisely.

It can be seen that modifications and further developments of the embodiment described above can be provided within the scope of the idea underlying the invention. Thus it may be advantageous to dispense with the closing spring provided for retraction of the drawer during the final closing movement if such a spring with sufficient spring tension for the retraction function assigned to it is provided in the opening and closing device of the respective other pullout guide of the pair of pull-out guides associated with a drawer. Then in this case in this second opening and closing device instead of the touch-latch mechanism according to the invention a linear damper can be provided which ensures that the final closing movement of the drawer takes place with a smooth delay.

The invention claimed is:

1. Closing and opening device for drawer pull-out guides with a guide rail to be fixed on a carcass wall of a piece of furniture and a running rail which is mounted so as to be displaceable relative to the guide rail and is to be fixed on the drawer, wherein, on a catch housing disposed on one of two aforementioned rails, a movable catch component is provided and is pretensioned by a spring arrangement in a bistable manner into two end positions spaced from one another in a direction of movement of the drawer, and the catch component has a seat for a dog which is provided on the outer rail and moves into the seat during the relative displacement of the rails as a closed position is approached and pivots the pretensioned movable catch component and thereby unlocks it from the associated end position, as a result of which the catch component is moved under the action of the spring tension into the other end position and by way of the dog held in the seat it entrains the rail associated therewith in the direction of retraction of the drawer, wherein the closing and opening device has a touch-latch mechanism that acts on the catch component or acts on or in the catch housing, wherein, when a pushing-in movement in a direction associated with closing the drawer is exerted on the drawer that is retained in the closed position by the closing and opening device, the touch-latch mechanism displaces the catch component and, by way of the dog engaging in the seat of the catch component, the touch-latch mechanism displaces the running rail and the drawer held on the running rail by a predetermined amount in a direction associated with opening the drawer.

2. The device according to claim 1, wherein the closing and opening device has an elongate hollow housing, one end of which is retained on or in the catch housing, wherein a coupling rod disposed so as to be longitudinally displaceable in the hollow housing is guided out of the other end of the housing and the end of the coupling rod projecting out of the hollow housing is coupled to the catch component, and that co-operating functional elements of the touch-latch mechanism are provided on the opposing end of the coupling rod received in the hollow housing and in the housing facing away from the catch component, and that the coupling rod is pretensioned by a pretensioned spring in the direction of a longitudinal displacement towards the catch component.

3. The device according to claim 2, wherein the free end of the coupling rod projecting out of the elongate hollow housing is coupled in an articulated manner on the catch component in such a way that the catch component is pivotable relative to the end of the coupling rod.

4. The device according to claim 3, wherein on the end of the coupling rod there is provided a joint head of substantially circular cross-section which for pivotable coupling on the catch component engages in a joint head seat in the catch component delimited in the shape of a circular arc over more than 180°, and that in the region which is open towards the coupling rod the joint head seat is constructed so that it is resiliently expandable in such a way that when a predetermined tensile force is exerted on the coupling rod or on the catch component the joint head disengages from the joint head seat in the sense of separating these parts from one another as the open mouth region expands resiliently.

5. The device according to claim 4, wherein the joint head has the shape of a ball head which is connected to the end of the coupling rod by way of a short connecting shank with a cross-sectional diameter which is reduced by comparison with the diameter of the ball head.

6. The device according to claim 2, wherein the touch-latch mechanism has a cam of cardioid shape which is provided in the interior of the elongate hollow housing and in which a control projection provided on the end of the coupling rod within the housing engages.

7. The device according to claim 6, wherein the control projection projects from the free end of a lever which is mounted on the end of the coupling rod within the housing so as to be pivotable about a control projection which engages in the cam parallel to a longitudinal central axis of the control projection.

8. The device according to claim 6, wherein, in a central portion of the interior of the elongate hollow housing, the coupling rod is guided so that it is displaceable in the longitudinal direction of the housing but is not rotatable relative to the housing.

9. The device according to claim 6, wherein the elongate hollow housing has at least two housing halves put together along a plane extending approximately centrally through the housing in the longitudinal direction, of which one is provided with the cam in the interior of its end region remote from the catch component, whilst the interior of the other housing half lying opposite the housing half provided with the cam is of hollow construction in such a way that the control projection provided on the end of the coupling rod within the housing can follow the transverse movements transmitted to it during a longitudinal displacement of the coupling rod by the cam, and that the spring under compression pretension is supported on or in the end region of the hollow housing nearest the catch component and in the region of the coupling of the coupling rod on the catch component.

10. The device according to claim 6, wherein the control projection is disposed so as to be displaceable transversely with respect to the longitudinal direction of the coupling rod but in the longitudinal direction of the coupling rod is not displaceable on the end of the coupling rod within the housing.

11. The device according to claim 10, wherein the end of the coupling rod within the housing has a guide head which is widened transversely with respect to the longitudinal direction of the coupling rod, wherein in the side of the guide head directed towards the cardioid-shaped cam a transversely extending guide groove is provided in which a support element is displaceably mounted, wherein the control projection projects from the underside of the support element facing the cam and engages in the cam.

12. The device according to claim 11, wherein the support element can advantageously have the shape of a cylindrical body of which the height is substantially equal to the depth of the guide groove and the diameter is equal to the width of the guide groove, wherein the control projection which engages in the cardioid-shaped control groove projects centrally from the end face of the body facing the cam.

13. The device according to claim 12, wherein the control projection has the shape of a pin with a circular cross-section in which the diameter is equal to the width of the cardioid-shaped control groove.

14. The device according to claim 13, wherein there is provided centrally in the base of the guide groove of the guide head an elongate hole in which a guide pin with a circular cross-section engages which projects centrally from the end face of the cylindrical body remote from the cam, the diameter of the guide pin being substantially equal to the width of the elongate hole.

15. The device according to claim 12, wherein there is provided centrally in the base of the guide groove of the guide head an elongate hole in which a guide pin with a circular cross-section engages which projects centrally from the end face of the cylindrical body remote from the cam, the diameter of the guide pin being substantially equal to the width of the elongate hole.

16. The device according to claim 1, wherein the elongate hollow housing has the external shape of an elongate cylinder.

17. The device according to claim 1, wherein the elongate hollow housing is supported at its end remote from the catch component on a stop which is adjustable in the longitudinal direction of the catch housing.

18. The device according to claim 17, wherein the stop is formed by an end surface of a setscrew screwed into a threaded bore in the catch housing.

19. The device according to claim 17, wherein the stop is formed by a set wheel which projects on an end face of the housing remote from the catch component, is screwed on with a threaded lug and provided with a complementary threaded hole.

20. The device according to claim 19, wherein the spring is formed by at least one helical spring fitted under compression pretension.

21. The device according to claim 17, characterised in that between the adjustable stop and the catch housing a spring is provided which cushions jerky stresses transmitted to the components of the touch-latch mechanism via the catch component as a drawer is closed.

22. The device according to claim 1, wherein the elongate hollow housing is guided so as to be longitudinally displaceable in the catch housing and its end remote from the catch component is supported in the catch housing by way of an interposed pretensioned spring, and that a stop which delimits the displacement path of the elongate hollow housing in the direction toward the catch component due to the pretension of the interposed spring is provided in the catch component.

23. The device according to claim 22, wherein the stop surface of the stop which supports the housing is constructed so as to be adjustable in the direction of displacement of the elongate housing.

24. The device according to claim 23, wherein the stop surface is formed by the free end of a shank of an adjusting screw which is screwed into a threaded bore in the catch housing and engages on a matching surface of the elongate housing, wherein the end of the adjusting screw lying opposite the matching surface is guided out of the catch housing and is provided with means for turning the shank.

25. The device according to claim 24, wherein the adjusting screw is provided in the catch housing so that it is oriented obliquely with respect to the direction of displacement of the elongate housing in such a way that when the shank of the adjusting screw is turned in the direction of screwing into the threaded bore the elongate housing is advanced against the direction of action of the pretension of the spring and when the shank is turned in the opposing direction the housing is advanced in the direction of action of the pretension of the spring.

26. The device according to claim 25, wherein the catch housing is provided with means for fixing on the underside of the guide rail of an associated pull-out guide in such a way that the catch component with the seat projects laterally adjacent to the guide rail in the direction towards the running rail, and that the dog provided on the running rail protrudes into the displacement path of the seat in the catch component.

27. The device according to claim 26, wherein the catch housing is constructed so that in the prescribed fixing position of the catch housing the catch component and the dog are provided on the guide rail laterally adjacent to the side thereof which faces the carcass.

* * * * *